United States Patent [19]

Ruiz

[11] Patent Number: 4,893,754

[45] Date of Patent: Jan. 16, 1990

[54] GENERATION OF FLAT LIQUID SHEET AND SPRAYS BY MEANS OF SIMPLE CYLINDRICAL ORIFICES

[76] Inventor: Francisco Ruiz, 831 S. Euclid Ave., Oak Park, Ill. 60304

[21] Appl. No.: 119,973

[22] Filed: Nov. 13, 1987

[51] Int. Cl.[4] ..... B05B 1/04

[52] U.S. Cl. ..... 239/601; 239/290; 239/461; 239/499; 239/589

[58] Field of Search ..... 239/567, 601, 589, 291, 239/496, 499, 533.2, 533.14, 290, 461, 491, 463, 468

[56] References Cited

U.S. PATENT DOCUMENTS

| | | | |
|---|---|---|---|
| 2,373,595 | 4/1945 | Peeps | 239/290 |
| 2,536,832 | 1/1951 | Altorfer | 239/468 |
| 3,072,346 | 1/1963 | Wahlin et al. | 239/601 |
| 3,759,448 | 9/1973 | Watkins | 239/597 |
| 3,810,583 | 5/1974 | George | 239/601 |
| 3,923,253 | 12/1975 | Stewart | 239/463 |
| 4,254,915 | 3/1981 | Müller | 239/533.12 |
| 4,346,848 | 8/1982 | Malcolm | 239/596 |
| 4,669,665 | 6/1987 | Shay | 239/463 |

FOREIGN PATENT DOCUMENTS

| | | | |
|---|---|---|---|
| 582841 | 5/1931 | Fed. Rep. of Germany | 239/499 |
| 2261726 | 6/1974 | Fed. Rep. of Germany | 239/533.2 |

*Primary Examiner*—Andres Kashnikow
*Assistant Examiner*—Christopher G. Trainor
*Attorney, Agent, or Firm*—William J. Ruano

[57] ABSTRACT

Apparatus and method of generating flat liquid sheet sprays by means of simple cylindrical orifices. One form is a container having an interior closed end with the exception of an orifice disposed eccentrically of the closed end to enable generation of a fine spray through the orifice. The orifice is rounded on the outside of the closed end. The orifices may extend radially outwardly instead or may take other forms.

1 Claim, 4 Drawing Sheets

Fig. 1B
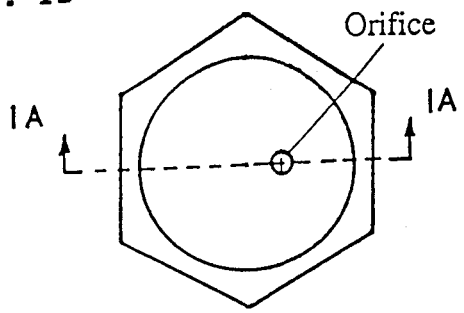
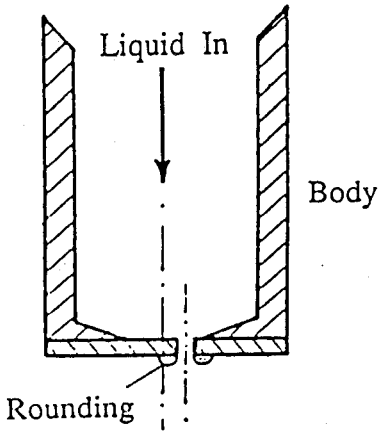
FIG. 1A

Fig. 2
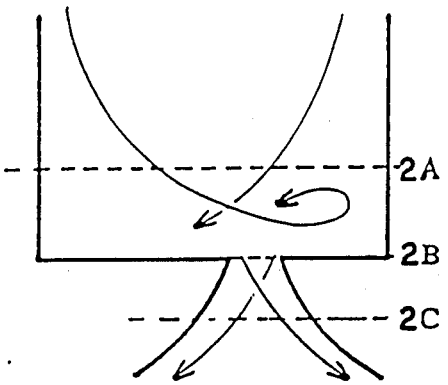
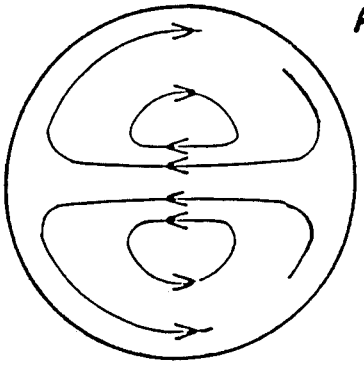
FIG. 2A
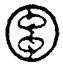
FIG. 2B
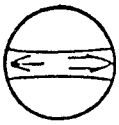
FIG. 2C

Fig. 4A
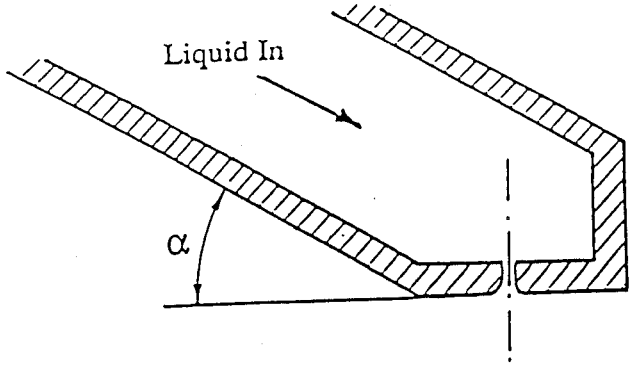
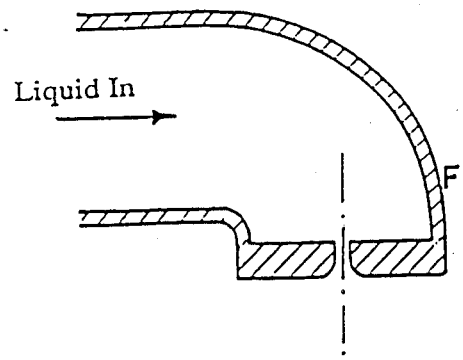
FIG. 4B
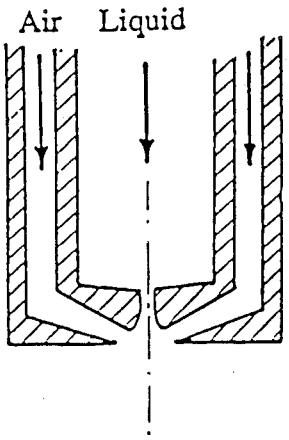
FIG. 4C

GENERATION OF FLAT LIQUID SHEET AND SPRAYS BY MEANS OF SIMPLE CYLINDRICAL ORIFICES

This invention relates to apparatus and method of generation of flat liquid sheet and sprays by means of simple cylindrical orifices

BACKGROUND OF THE INVENTION

The atomization of liquid injected under pressure through an orifice is a process frequently found in many industrial processes, such as painting, and fuel injection. A simple system producing a good dispersion, and maintaining a clog-free operation, is being sought in these fields. In order to reduce particular emissions from diesel engines, it is convenient to improve the dispersion of the fuel injected near the end of the compression stroke. Current injection processes attempt to achieve this by multiplying the number of spray plumes produced within the combustion chamber (multiorifice injectors), by imparting a vigorous swirling motion to the air contained in the cylinder, or by injecting the fuel against a highly heated wall, where it quickly vaporized (indirect injection). The multiorifice injectors are unreliable at high loads, since the fuel reaches the cylinder walls without vaporizing or burning, and at low loads, since the performance of orifice sprays is very sensitive to the injection pressure, and the atomization of the fuel is poor at low injection pressures. Air swirl requires spending a significant fraction of the compression work into the generation of high air velocities, with the consequent reduction in thermal efficiency. Indirect injection inherently leads to larger heat losses, due to the larger surface area of the combustion chamber.

Gasoline injectors, while not being subject to the same stringent conditions of heat transfer and optimum dispersion required of diesel injectors, are subject to clogging problems that originate poor engine performance and high emissions when a three-way catalyst is used at the exhaust. Atomization is usually achieved by generating thin fuel sheets by pintle-type atomizers, or jets produced by small holes. Clogging is a problem because the pintle gap or typical orifice size is very small, and residues coming from evaporated fuel tend to accumulate in them. An injector generating a fine spray, with larger holes, and capable of supporting multiple orifices would minimize the clogging problem.

Finally, in other industrial processes, such as gas turbine combustion and spray painting, for instance, a flat spray of nearly uniform drop distribution is frequently sought. The current "fan" atomizers are simple, but the presence of obstacles in the upstream flow limit their clog-free operation. It is nearly always necessary to provide a flow of secondary air, either to help atomization, or to modify into a flat shape a spray that otherwise would have a circular cross-section.

Some atomizers (see, for instance U.S. Pat. No. 3,759,448) generate a "fan" spray by splitting the flow into two streams, that are caused to impinge at the orifice. However, this process requires a careful machining of parts, cannot easily support multiple orifices per injector, and is sensitive to clogging, due to the obstruction in the flow. Many other atomizers generating fan sprays need an air supply to feed the "horns" that shape the spray into a flat sheet.

SUMMARY OF THE INVENTION

It is the object of this invention to:

(1) Provide that maximum possible degree of atomization achievable by simple orifices of easy manufacture.

(2) Do so without the help of splitter plates, vanes, or swirlers that could obstruct the flow and produce clogging and high pressure losses.

(3) Be able to operate in a multiple-orifice configuration, to achieve an even better dispersion and resistance to clogging.

(4) Have an easy implementation, requiring only small modifications of the tips of the current atomizers, carried out with conventional tooling.

BRIEF DESCRIPTION OF THE DRAWINGS

FIG. 1A shows the section and FIG. 1B top view of a nozzle built and performing using the process described herein:

FIG. 2 is a schematic representation of the physics of the new injection process.

FIGS. 2A 2B and 2C are sections taken along line 2A—2A, 2B—2B and 2C—2C, respectively.

FIGS. 4A, 4B and 4C present in a schematic way other variations of the same working principle, producting the same effect.

DESCRIPTION OF THE PREFERRED EMBODIMENT

Figure 3A:
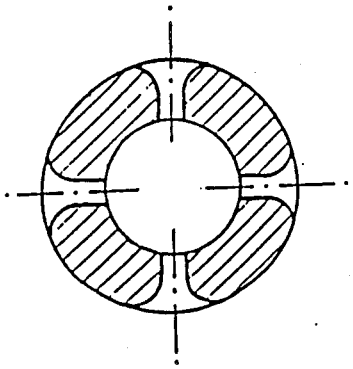
FIGS. 3A and 3B are alternative embodiments of the same principle, as a multiorifice fuel injector tip. Two alternative sections at the plane of the orifices are shown.

This invention deals with the means of producing an extraordinary mode of atomization in cylindrical orifice injectors, by amplifying special fluid-mechanics effects through the careful design of the orifices. FIG. 1A represents an example of a nozzle using the new process. This nozzle was actually built and tested. It comprises:

1. A body, of internal cylindrical shape, though which the liquid to be atomized is supplied, having at its end a flat surface or "orifice plate"

2. A round orifice, offset from the center, and having a gradually opening outlet. The orifice has a diameter much smaller than that of the body, and its length before the opening is about equal to its initial diameter. The profile of the rounded part is circular, although a logarithmic spiral profile would be more appropriate for injectors generating large fan angles (over 60°). The prototype generated a flat sheet spray when the injection pressure differntial was higher than 30 psig. The orifice diameter was 300 um, the body diameter ¼ in., and the offset 1/16 in. The opening outlet was constructed in the prototype by partial suction of a drop of plastic material, placed on the outside. It can be made, in a general case, by laser, EDM, or conventional machining, using a special bit or flaring tool.

This nozzle, as all others discussed in the present invention, achieves a flat spray by the interaction of the following two phenomena (see FIG. 2):

(a) When the supply line, leading to the injecting orifice, is curved, skewed, or eccentric with respect to the orifice, a secondary flow is generated, consisting of a pair of counter-rotating vortices (FIG. 2A). These vortices reach into the orifice, where they are stretched as the flow cross-section is reduced.; the rotational velocity is increased as a consequence of the stretching (FIG. 2B). In these circumstances, the jet emerging from the orifice has a tendency to lose its circular shape, and to form a sheet, but is prevented from doing so by surface tension forces, acting on the jet surface, that tend to minimize the perimeter of the jet cross-section.

(b) The formation of the sheet is stabilized by the Coanda effect. If the orifice outlet is rounded, or has a conical opening of low angle, the emerging jet remains attached to the orifice wall at two diametrically opposed points (FIG. 2C). Local pressure forces maintain this attachment up to the end of the orifice wall (or until the wall boundary layer becomes unstable, and separation occurs.). The gradual opening stabilizes the divergence of the jet, which is eventually transformed into a triangular sheet, whose included angle depends on the opening angle of the orifice, at the separation point.

Thus the combination of these two phenomena produces a flat "fan" spray out of a cylindrical orifice, with no additional means.

Although the secondary flow is achieved, in the prototype, by the eccentricity of the orifice with respect to the nozzle body, other means producing the same double-vortex secondary flow—such as skewness or bending of the flow leading to the orifice—would cause the same interaction with the Coanda effect, and hence, the same flat sheet generation.

The orifice does not necessarily have a circular cross-section. Other cross-sectional shapes (elliptical, rectangular, etc.), though more difficult to manufacture, have the capability of enhancing even more the interaction of the secondary flow with the Coanda effect.

The orifice must be short. It does not make much difference whether the inlet be rounded or not (the outlet must, of course, be rounded or conical). The non-diverging part of the orifice should have a length substantially equal to the diameter. This is necessary for a local maximum of the axial flow velocity to exist near the orifice wall, making possible the appearance of the Coanda effect which is a particular phenomenon associated with the effect of convex curvature on wall jets. If the orifice is much longer, this local maximum will disappear due to the growth of the wall boundary layer. Likewise, if the orifice is much shorter, the jet flow formed at the inlet will fail to attach to the orifice wall at all.

The fluid must not be so viscous that a secondary flow is prevented. The process is based primarily on inviiscid flow effects, such as secondary flow, vortex stretching, and the Coanda effect. To atomize very viscous fluids, it may be necessary to reduce the viscosity by heating the liquid in the supply line, before the atomizer.

The Coanda effect has been used before in atomizers (see, for instance, the original U.S. patents of H. Coanda, Nos. 2,713,510; 2,826,454; and 2,988,303), but just in order to carry the liquid to a place where it can be atomized by air interaction. More recent applications (U.S. Pat. No. 4,324,361) use the Coanda effect to increase the duration of the contact between liquid and atomizing air (supplied at the center, in this case) and to enhance the atomization. However, the Coanda effect is not as central to those processes as it is in the present invention. Here, the liquid fan is "pulled open" by the Coanda effect, while in other fan atomizers the liquid is "squeezed" into a sheet, instead. The required time for the new process to operate is a fraction of that needed by othe fan atomizers, due to the local low pressure generated by the Coanda effect at the opening section of the orifice. This "Opening"-versus "squeezing"-action also means that the flow is free from obstruction and clogging is less likely.

ALTERNATIVE EMBODIMENTS

Figure 3B:
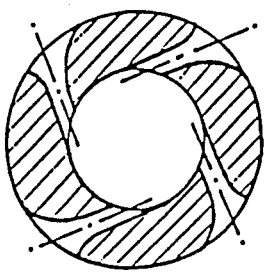
Figure 3C:
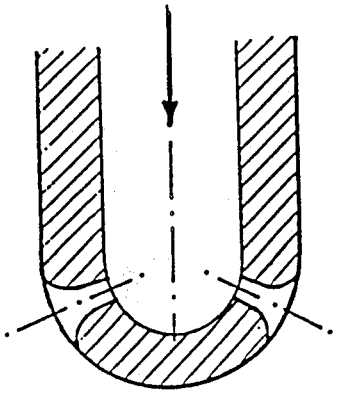
FIG. 3C is a vertical section.

FIG. 3A shows the application of the principle to a diesel injector tip. Four orifices are drilled on the tip. FIG. 3A corresponds to a case in which the main offset is in the axial direction, and so the flat spray generated by each hole will be parallel to the injector axis. FIG. 3B corresponds to a case in which the main offset is in the radial direction, and so the flat spray generated by each hole will be perpendicular to the injector axis. An injector having two staggered hole planes like those in FIGS. A and B would generate an alternation of flat sprays in different orientations, thereby producing a very effective dispersion of the fuel.

FIGS. 4A, B and C show vertical sections of other embodiments of the principle;

FIG. 4A shows a skewed entrance, at an angle a, where a can vary from 0° to 90°, possibly combined with orifice offset. This skewed entrance contributes to the generation of a secondary flow.

FIG. 4B shows a curved entrance, where the secondary flow generated at a pipe bend is used instead. If can also be combined with a skewed entrance and/or an orifice offset.

FIG. 4c shows an air-assist, where secondary air is used to shape the spray or foster the atomization of the sheet generated by any of the nozzle embodiments described above.

In addition to air-assist, other effects can be used to help the performance of the atomizers. (a) Electrostatic charge, causing the fluid particles to repel each other, thereby fostering atomization. (b) Heating of the liquid within the supply line, causing its viscosity to drop, and improving the generation of a secondary flow.

Thus it will be seen that I have provided a novel spray device and method that has the following advantages:

A new spray process has been developed that generates a flat sheet spray directly at the exit of a specially designed orifice, without splitter plates, vanes, the addition of a supply of air, nor swirler. The atomization improvement achieved by this process is due only to the geometry of the final orifice. The flat sheet spray has a faster atomization, better mixing with the surrounding air, and a more uniform distribution than the jet spray normally generated by an orifice. The atomizer is resistant to clogging, since it does not have any vanes or other features that could present an obstacle to the flow, and allows multiple orifices per injector, each one generating a sheet spray. The adaptation of existing atomizers to use the new spray process is very simple, only requiring a different design of the nozzle orifices. The orifices can be drilled directly using standard manufacturing techniques. The rest of the atomizer needs not be modified. These advantages can be important, for instance, in spray painting and in fuel injection, whose effectiveness is greatly related to the degree of atomization, and the local distrubution achieved, as well as their clog-free operation.

While I have illustrated and described several embodiments of my invention, it will be understood that these are by way of illustration only and that various changes and modifications may be contemplated in my invention and within the scope of the following claims:

I claim:

1. An atomizer for generating a flat liquid sheet spray comprising:

a hollow cylindrical container having a central longitudinal axis, said container being devoid of any obstacle to fluid flow and devoid of any additional air supply, said hollow cylindrical container having a substantially flat closed end; and an orifice disposed in said flat closed end eccentrically offset from the axis of said container, said orifice being cylindrical and having a length substantially equal to its width and having an adjacent outwardly flared portion to provide a gradually opening outlet; and wherein the eccentricity of the orifice enables generation of a secondary flow of liquid consisting of a pair of counter-rotating vortices so that the flat liquid sheet spray emerges through said orifice, said flat liquid sheet spray being stabilized by the Coanda effect acting on said gradually opening outlet.

* * * * *